US010280935B2

(12) United States Patent
Richardson

(10) Patent No.: US 10,280,935 B2
(45) Date of Patent: May 7, 2019

(54) INTEGRAL FAN AND AIRFLOW GUIDE

(71) Applicant: Parker-Hannifin Corporation, Cleveland, OH (US)

(72) Inventor: Jason S. Richardson, Chuckey, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 265 days.

(21) Appl. No.: 15/468,705

(22) Filed: Mar. 24, 2017

(65) Prior Publication Data

US 2017/0306975 A1 Oct. 26, 2017

Related U.S. Application Data

(60) Provisional application No. 62/327,730, filed on Apr. 26, 2016.

(51) Int. Cl.

| | |
|---|---|
| ***F04D 29/32*** | (2006.01) |
| ***F04D 25/02*** | (2006.01) |
| ***F04D 29/38*** | (2006.01) |
| ***F04D 29/54*** | (2006.01) |

(52) U.S. Cl.

CPC ..... *F04D 29/329* (2013.01); *F04D 25/02* (2013.01); *F04D 29/384* (2013.01); *F04D 29/541* (2013.01)

(58) Field of Classification Search

None

See application file for complete search history.

(56) References Cited

U.S. PATENT DOCUMENTS

| | | | | |
|---|---|---|---|---|
| 4,451,202 | A * | 5/1984 | Hauser | F01D 5/34 123/41.11 |
| 6,010,305 | A * | 1/2000 | Hauser | F04D 25/022 416/169 A |
| D453,827 | S | 2/2002 | Kuo | |
| 6,375,427 | B1 * | 4/2002 | Williams | F04D 29/326 416/169 A |
| 6,382,915 | B1 * | 5/2002 | Aschermann | F04D 25/022 416/169 A |
| 6,468,037 | B1 * | 10/2002 | Link | F04D 25/026 416/169 A |

(Continued)

OTHER PUBLICATIONS

Parker-Hannifin Corporation, HTG Transmission Product Series Service Procedure, HY13-1524-001/US, Jun. 2012.

(Continued)

*Primary Examiner* — Michael Lebentritt
(74) *Attorney, Agent, or Firm* — Renner Otto

(57) ABSTRACT

An integral fan and airflow guide including a hub having a frusto-conical outer surface, and a plurality of fan blades circumferentially spaced apart about the hub and radiating outwardly from the hub. The frusto-conical outer surface having a plurality of circumferentially spaced apart slots that separate inclined segments of the outer surface to define respective airflow guide surfaces. The plurality of fan blades are integral with the respective airflow guide surfaces. The inclined airflow guide surfaces cooperate with the fan blades to direct impelled air axially and radially outwardly for improving the cooling of a machine component, such as a hydrostatic transmission, that is obstructed from airflow by a pulley or other obstacle.

20 Claims, 6 Drawing Sheets

(56) References Cited

U.S. PATENT DOCUMENTS 6,565,320 B1 * 5/2003 Surls ..... F04D 29/329 416/175
D485,904 S 1/2004 Tsai
D486,572 S 2/2004 Chen
6,830,434 B2 * 12/2004 Kondo ..... F04D 29/329 416/169 A
D507,343 S 7/2005 Chiu
D509,584 S 9/2005 Li
D560,789 S 1/2008 Lee
D564,653 S 3/2008 Iwase
D570,999 S 6/2008 Harman
D645,134 S 9/2011 Lee
8,303,259 B2 * 11/2012 Kim ..... F04D 29/34 416/213 A
D773,639 S 12/2016 Shen
2002/0006331 A1 * 1/2002 Moreau ..... F04D 29/544 415/211.2
2006/0093478 A1 5/2006 Liu
2007/0297905 A1 * 12/2007 Muller ..... F01D 5/34 416/198 R
2008/0145230 A1 6/2008 Harman
2010/0202886 A1 * 8/2010 Iwata ..... F04D 29/30 416/182
2010/0247344 A1 * 9/2010 Yang ..... F04D 25/0613 417/410.1
2010/0260608 A1 10/2010 Suzuki
2010/0316498 A1 * 12/2010 Cahill ..... F04D 29/023 416/189
2012/0171043 A1 * 7/2012 Lee ..... F04D 29/164 416/235
2012/0174547 A1 * 7/2012 Tornblom ..... B01D 45/14 55/461
2013/0115067 A1 * 5/2013 Bronfeld ..... F01D 5/06 415/185
2013/0302156 A1 * 11/2013 Nurzynski ..... F04D 17/06 415/208.1
2013/0323072 A1 * 12/2013 Aschermann ..... F04D 25/022 416/234
2014/0030104 A1 1/2014 Lee
2016/0305448 A1 * 10/2016 Hong ..... F01P 1/06
2017/0002833 A1 * 1/2017 Lin ..... F04D 29/281
2017/0167505 A1 * 6/2017 Oh ..... F04D 19/002
2017/0298947 A1 * 10/2017 Richardson ..... F04D 29/329

OTHER PUBLICATIONS

Parker-Hannifin Corporation, Integrated Hydrostatic Transmissions, HTE/HTJ/HTG Series, Catalog No. HY13-1595-002/US, 2012.

* cited by examiner

INTEGRAL FAN AND AIRFLOW GUIDE

RELATED APPLICATIONS

This application claims the benefit of U.S. Provisional Application No. 62/327,730 filed Apr. 26, 2016, which is hereby incorporated herein by reference in its entirety.

FIELD OF INVENTION

The present invention relates generally to a fan and airflow guide for cooling a machine component, and more particularly to an integral fan and airflow guide for cooling a hydrostatic transmission.

BACKGROUND

A prime mover, such as an internal combustion engine or the like, can be connected to a low speed, high torque hydrostatic transmission. A hydrostatic transmission is particularly suitable to provide traction drive for a vehicle, such as turf machines, lawn tractors, ride-on lawn mowers, and like devices. A simple usage of hydrostatic transmissions is on zero-turn radius vehicles, including zero-turn radius mowers and tractors.

Generally, a hydrostatic transmission includes a hydraulic pump and a hydraulic motor. The hydraulic pump usually is a piston-type pump including a plurality of reciprocating pistons which are in fluid communication through hydraulic porting with the hydraulic motor. Rotation of the hydraulic pump against a moveable swash plate creates an axial motion of the pump pistons that forces hydraulic fluid through the hydraulic porting to the hydraulic motor to drive the motor, which allows the transmission output speed to be varied and controlled. The rotation of the hydraulic motor may be used to drive an output shaft, which in turn ultimately drives a wheel axle of a vehicle of the types described above.

The hydrostatic transmission is one example of a machine component that generates heat due to rotating components and work done by the transmission. Typically, a standard fan is provided to cool an exterior housing of the hydrostatic transmission. In some cases, the standard fan is mounted to an input shaft of the hydraulic pump, which is driven by a pulley connected to the input shaft. However, in some common hydrostatic transmissions, the pulley is mounted to the shaft between the fan and the transmission housing. The pulley then acts as an obstacle that restricts airflow to the housing and impairs the cooling effect of the fan.

A general configuration of a hydrostatic transmission is shown and described in Parker-Hannifin Corporation, Cleveland, Ohio, USA, Service Manual HY13-1524-001/US, the entire contents of which is hereby incorporated herein by reference. The referenced Service Manual shows, inter alia, a basic hydrostatic transmission with a top-mounted pulley and a standard fan in exploded view at pages 10 and 11. Another general configuration of a hydrostatic transmission is shown and described in Parker-Hannifin Corporation Catalog No. HY13-1595-002/US, the entire contents of which is hereby incorporated herein by reference. The referenced Catalog shows, inter alia, a basic hydrostatic transmission with a top-mounted pulley and a standard fan at page 13, for example.

SUMMARY OF INVENTION

The present invention provides, among other things, an integral fan and airflow guide having a frusto-conical hub with at least one inclined airflow guide surface that is integral with a plurality of circumferentially spaced apart fan blades. The inclined airflow guide surface cooperates with the fan blades to direct impelled air axially and radially outwardly for improving the cooling of a machine component that is obstructed from airflow by a pulley or other obstacle beneath the fan blades. For example, the inclined airflow guide surface may be configured to extend to a radially outward edge of the pulley or other obstacle to direct airflow around the edge of the obstacle for improving cooling of the machine component located below.

The frusto-conical hub may also have a plurality of circumferentially spaced apart slots that separate the inclined airflow guide surfaces. The respective fan blades may axially overlay the respective slots, and the slots may be configured to allow impelled airflow through the slots to further improve cooling to an area below the airflow guide surfaces. For example, the axial airflow directed through the slots may be forced through apertures in the pulley or other obstacle to cool a radially inward area on the other side of the obstacle.

In some embodiments, the integral fan and airflow guide is a unitary member made by an injection molding process. The circumferentially spaced apart slots may also help to improve the ease of injection molding, which reduces the cost to manufacture such a device.

According to an aspect of the invention, an integral fan and airflow guide includes a hub having a central axis and a frusto-conical outer surface, the frusto-conical outer surface having a plurality of circumferentially spaced apart slots that separate inclined segments of the outer surface to define respective airflow guide surfaces, and a plurality of fan blades circumferentially spaced apart about the hub, the plurality of fan blades radiating outwardly from the hub and being integral with the respective airflow guide surfaces.

Embodiments of the invention may include one or more of the following additional features separately or in combination.

For example, the airflow guide surfaces may be configured to cooperate with the respective fan blades to direct impelled air axially and radially outwardly.

The respective fan blades may radiate from the hub at respective edges of the slots.

The slots may have a leading edge and a trailing edge, and the fan blades may be integral with the trailing edges of the slots.

The slots may be wedge-shaped and a wider portion of the wedge-shaped slot may be toward a base of the frusto-conical outer surface.

The respective fan blades may circumferentially span the respective slots.

The respective fan blades may have a radially inward end, and the radially inward ends of the fan blades may be continuously integral with the airflow guide surfaces.

The airflow guide surfaces may have a lower edge at a base of the frusto-conical outer surface, and the respective fan blades may have a lower edge that does not extend beyond the lower edge of the respective airflow guide surfaces.

The respective fan blades may be sloped relative to the respective airflow guide surfaces.

The fan blades may be inclined with respect to a plane perpendicular to the central axis, and may be perpendicular to a plane parallel with the central axis.

The respective fan blades may have a concave surface opening toward the respective slots.

The hub may have a radially inner mounting flange configured to operatively couple the integral fan and airflow guide to a rotating shaft.

The mounting flange may include a mounting face.

The mounting face may have an aperture configured to accept a shaft.

The mounting flange may include one or more locating pins.

The hub may include an axially extending inward rim that encloses the mounting flange.

The integral fan and airflow guide may further include a plurality of ribs interconnecting respective portions of the inclined segments and respective portions of the mounting flange for enhancing rigidity and restricting flexing of the inclined segments during use.

At least one rib may be connected to the underside of each inclined segment and to an underside of the mounting flange of the hub.

The integral fan and airflow guide may further include a plurality of ribs interconnecting respective portions of the rim of the hub and respective portions of an upper face of the mounting flange for enhancing rigidity and restricting flexing during use.

The plurality of ribs connected to the rim may correspond with the plurality of ribs connected to the inclined segments.

The integral fan and airflow guide may be a unitary molded member.

According to another aspect of the invention, an integral fan and airflow guide includes a frusto-conical hub having an apex, a base, and an inclined airflow guide surface between the apex and the base; and a plurality of fan blades circumferentially spaced apart about the frusto-conical hub, the plurality of fan blades being integral with inclined airflow guide surface and radiating outwardly from the hub.

According to another aspect of the invention, an integral fan and airflow guide for cooling a machine component includes a hub having a central axis; a plurality of airflow guide surfaces extending axially from the hub, the airflow guide surfaces being outwardly inclined with respect to the central axis; and a plurality of radially outwardly extending fan blades circumferentially spaced apart about the hub intermediate the airflow guide surfaces. The respective airflow guide surfaces are integral with the plurality of fan blades, the airflow guide surfaces being configured to cooperate with the respective fan blades to direct impelled air axially and radially outwardly.

According to another aspect of the invention, a machine component includes a housing, a rotatable shaft, a pulley operatively connected to the shaft, and an integral fan and airflow guide according to any of those described above, which is operatively coupled to the rotatable shaft. The pulley may be disposed between the housing and the integral fan and airflow guide, the pulley having a mounting face and a radial edge enclosing the mounting face, the mounting face of the pulley having at least one through-hole.

The integral fan and airflow guide may be configured to direct impelled airflow axially through the respective slots of the hub and through the at least one through-hole of the pulley to cool an area of the housing on the opposite side of the pulley that is radially inward of the radial edge of the pulley.

In addition, the integral fan and airflow guide may be configured to direct impelled airflow radially toward the radial edge of the pulley to cool an area of the housing on the opposite side of the pulley that is radially outward of the radial edge.

Optionally, the pulley of the machine component may have a radial lip, and a lower free edge of the respective airflow guide surfaces may be configured to engage an underside of the radial lip so as to restrict flexing of the respective guide surfaces in response to forces generated from airflow across the integral the integral fan an airflow guide.

In exemplary embodiments, the machine component is a hydrostatic transmission.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

The principles of the present invention have particular application to hydrostatic transmissions with top mounted pulleys, and thus will be described below chiefly in this context. The hydrostatic transmission may be implemented in a vehicle configuration having a dual hydrostatic transmission system, where a right side transmission drives a right side wheel and a left side transmission drives a left side wheel. Such dual hydrostatic transmission systems are particularly suitable for zero-turn radius mowers and lawn tractors. In an alternative vehicle configuration, a modular hydrostatic transaxle system includes a single hydrostatic transmission attached to a transaxle including a differential gearing system and an axle shaft. In either configuration, the vehicle wheels are driven via a gear reduction system that is driven by the one or dual hydrostatic transmissions. However, it is also understood that principles of this invention may be applicable to other machine components in which a pulley or other obstacle obstructs cooling airflow from a fan, and where it is desirable to direct airflow around the edge of the obstacle and/or through the obstacle for improving cooling of the machine component. For example, the machine component may be a hydraulic machine such as a hydraulic pump, a hydraulic motor, a hydraulic pump/motor, or similar type of hydraulic machine with or without a housing.

In the discussion above and to follow, the terms "upper," "lower," "top," "bottom," "end," "inner," "outer," "above," "below," etc. refer to an exemplary hydrostatic transmission having an exemplary integral fan and airflow guide, as oriented in FIG. 1. This is done realizing that these units, such as when used on vehicles, can be mounted on the top, bottom, or sides of other components, or can be inclined with respect to the vehicle chassis, or can be provided in various other positions. Furthermore, the terms "upstream," "downstream," "leading," and "trailing" refer to the direction of rotation of the integral fan and airflow guide when rotating in a clockwise direction, as shown by the arrows in FIG. 1. This is done realizing that the integral fan and airflow guide may rotate in either direction depending on its location and the system requirements.

Figure 1:
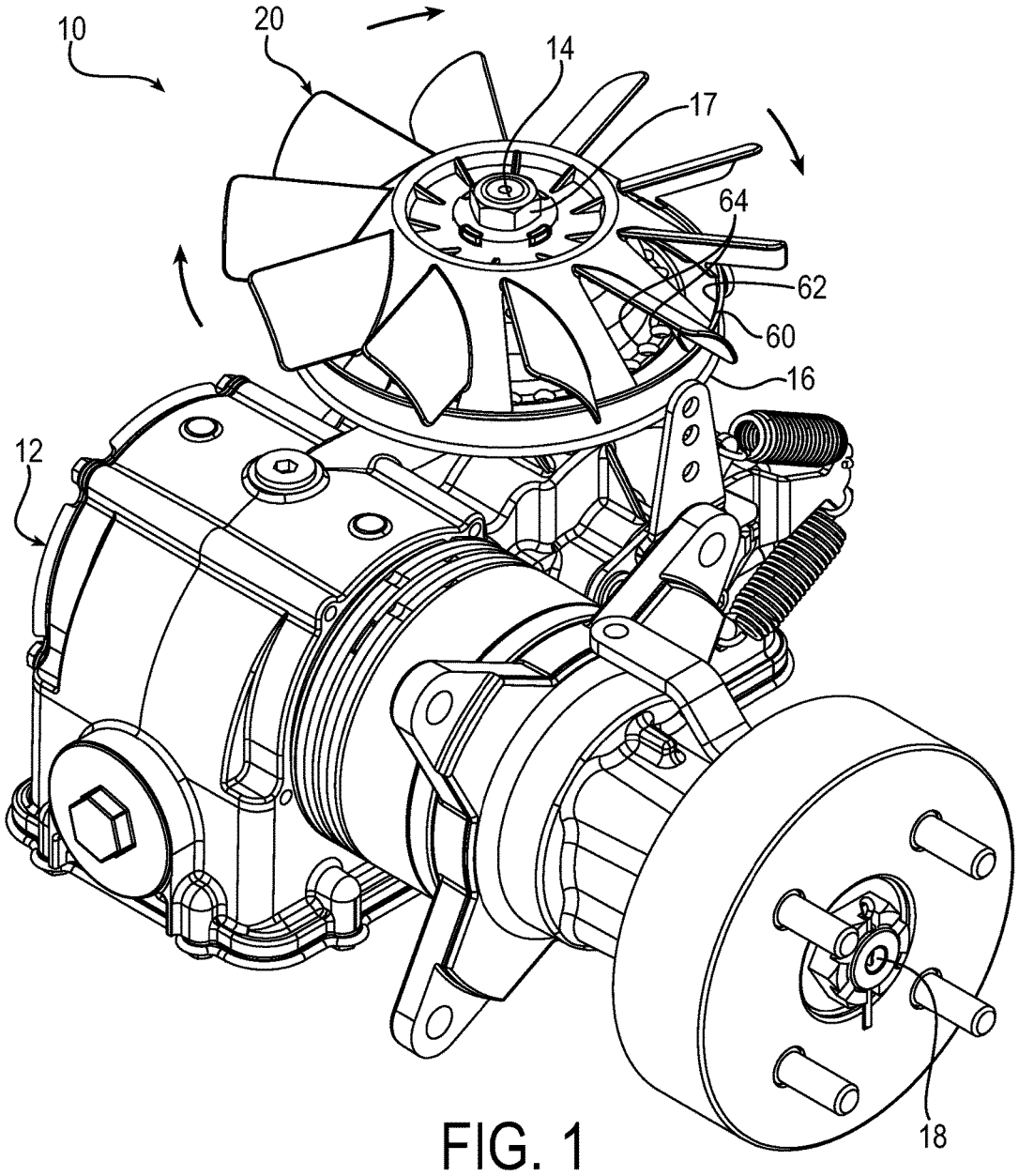
FIG. 1 is a perspective view of an exemplary hydrostatic transmission having an exemplary integral fan and airflow guide according to the invention.
Figure 2:
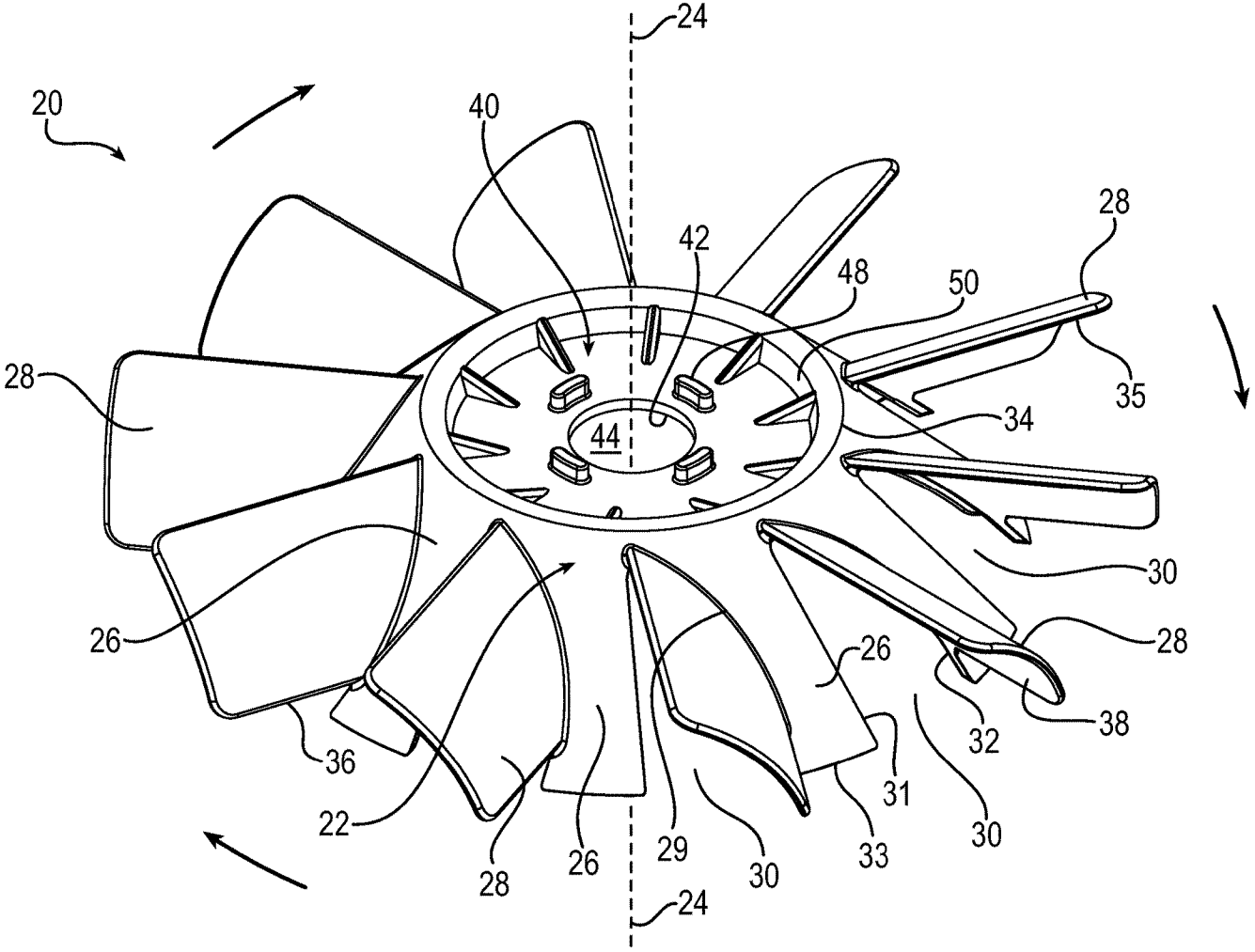
FIG. 2 is an isometric view of an exemplary integral fan and airflow guide.

Referring to FIG. 1, an exemplary hydrostatic transmission 10 is shown. The hydrostatic transmission 10 includes a hydraulic pump and a motor sub-assembly. The hydraulic pump and motor sub-assembly are housed within a housing 12 of the hydrostatic transmission 10. The hydrostatic transmission 10 includes porting and internal passages for communicating hydraulic fluid between the pump and the motor sub-assembly. The pump includes an input shaft 14 that extends through the housing 12. The input shaft 14 is operatively coupled to an input belt-driven pulley 16 operatively connected to a prime mover of the hydrostatic transmission, such as an internal combustion engine. As shown in FIG. 1, the pulley 16 is positioned at a top end portion of the input shaft 14 above the housing 12. The pulley 16 is configured to rotate the input shaft 14, for example, clockwise as shown by the arrows in the illustrated embodiment. The rotation of the input shaft 14 may drive a piston rotating group of the pump against a running face adjacent a rotatable swash plate. With the rotation of the swash plate, the pistons of the rotating group may extend and contract to drive hydraulic fluid in and out. The flow is directed through the motor to produce a power output via an output shaft 18. The output shaft 18 may be configured to deliver power to at least one of the vehicle wheels.

As shown in FIG. 1, an exemplary integral fan and airflow guide 20 is operatively coupled to the input shaft 14 and is configured to rotate with the input shaft 14 to direct impelled airflow downward toward the housing 12. The integral fan and airflow guide 20 may be attached for rotation with the input shaft 14 via a fastening mechanism 17. Any suitable fastening mechanism may be used, such as via a washer and a nut securably threaded onto the shaft 14 (as shown), or via cotter pins, screws, bolts, adhesives, and the like.

Referring to FIGS. 2-5, the exemplary integral fan and airflow guide 20 is shown in further detail. The exemplary integral fan and airflow guide 20 includes a hub 22 having a central axis 24 and an outer surface that defines one or more airflow guide surfaces 26. In exemplary embodiments, the outer surface may have a frusto-conical configuration in which a diameter of the outer surface relative to the central axis increases in a direction from the top end of the input shaft toward the pulley. Accordingly, as shown, the respective airflow guide surfaces 26 are outwardly inclined with respect to the central axis 24, for example, by 10-degrees or more. The exemplary integral fan and airflow guide 20 also includes a plurality of fan blades 28 circumferentially spaced apart about the hub 22 and which extend radially outwardly from the hub 22. As shown, the fan blades 28 have a radially inward end 29 that is integral with the respective airflow guide surfaces 26 such that they together form a continuous and unitary surface.

The frusto-conical hub 22 may define a plurality of spaced apart slots 30 that separate inclined segments of the airflow guide surfaces 26. The slots 30 each have a leading edge 31 and a trailing edge 32 that are edges of opposing guide surfaces that enable airflow therebetween. The slots 30 may be wedge-shaped with a wider end toward a base or lower edge 33 of the frusto-conical hub 22, and a narrower end of the wedge-shaped slot 30 being toward an apex or top edge 34 of the frusto-conical hub 22. The slots 30 may extend substantially from the apex 34 to the base 32 to define a gradually widening gap between the airflow guide surfaces 26.

Figure 3:
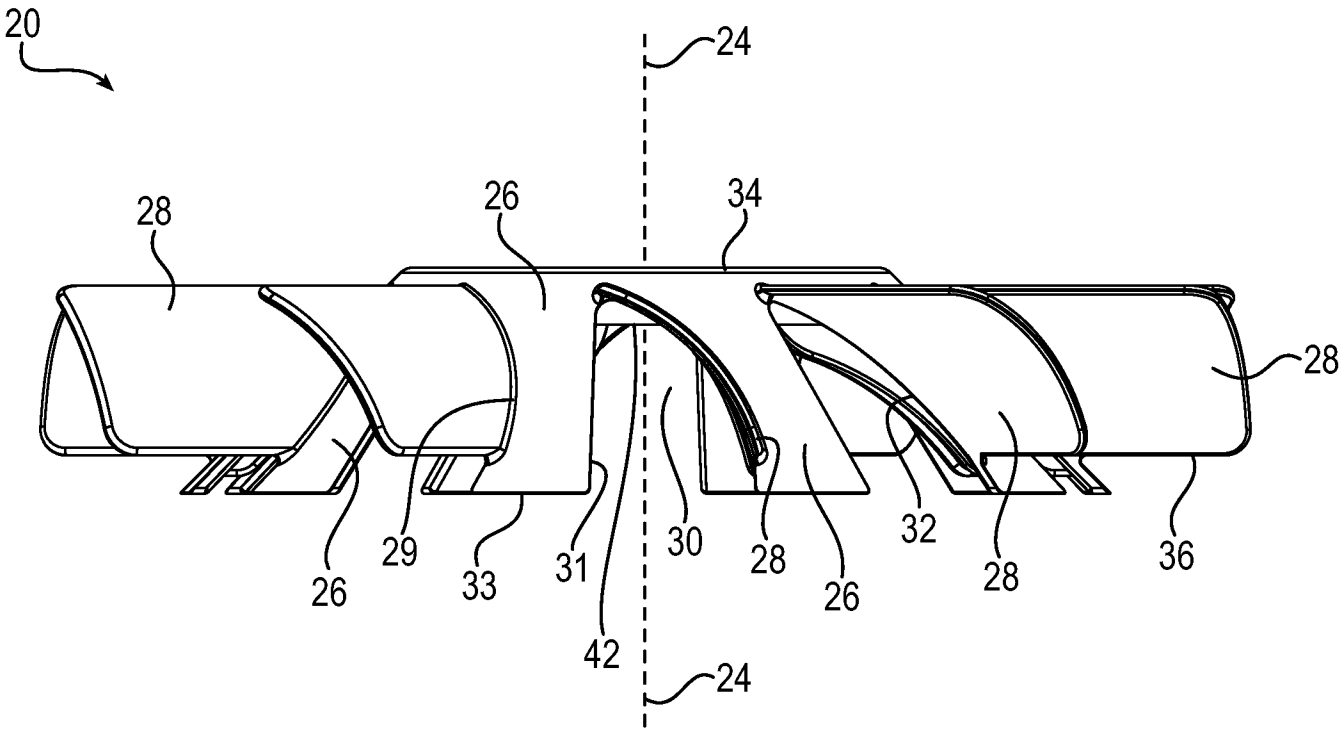
FIG. 3 is a side view of the integral fan and airflow guide of FIG. 2.
Figure 4:
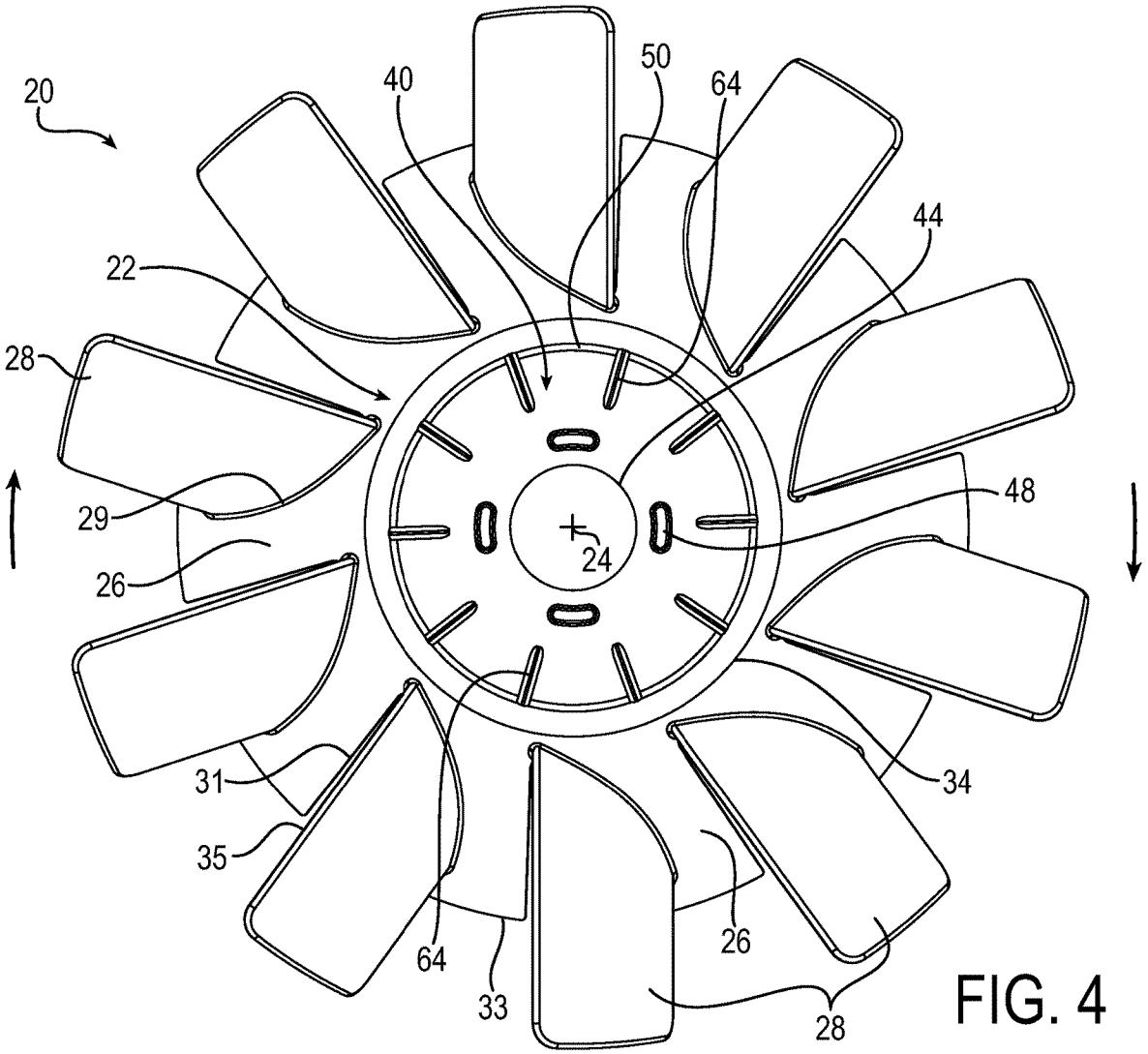
FIG. 4 is a top plan view of the integral fan and airflow guide of FIG. 2.
Figure 5:
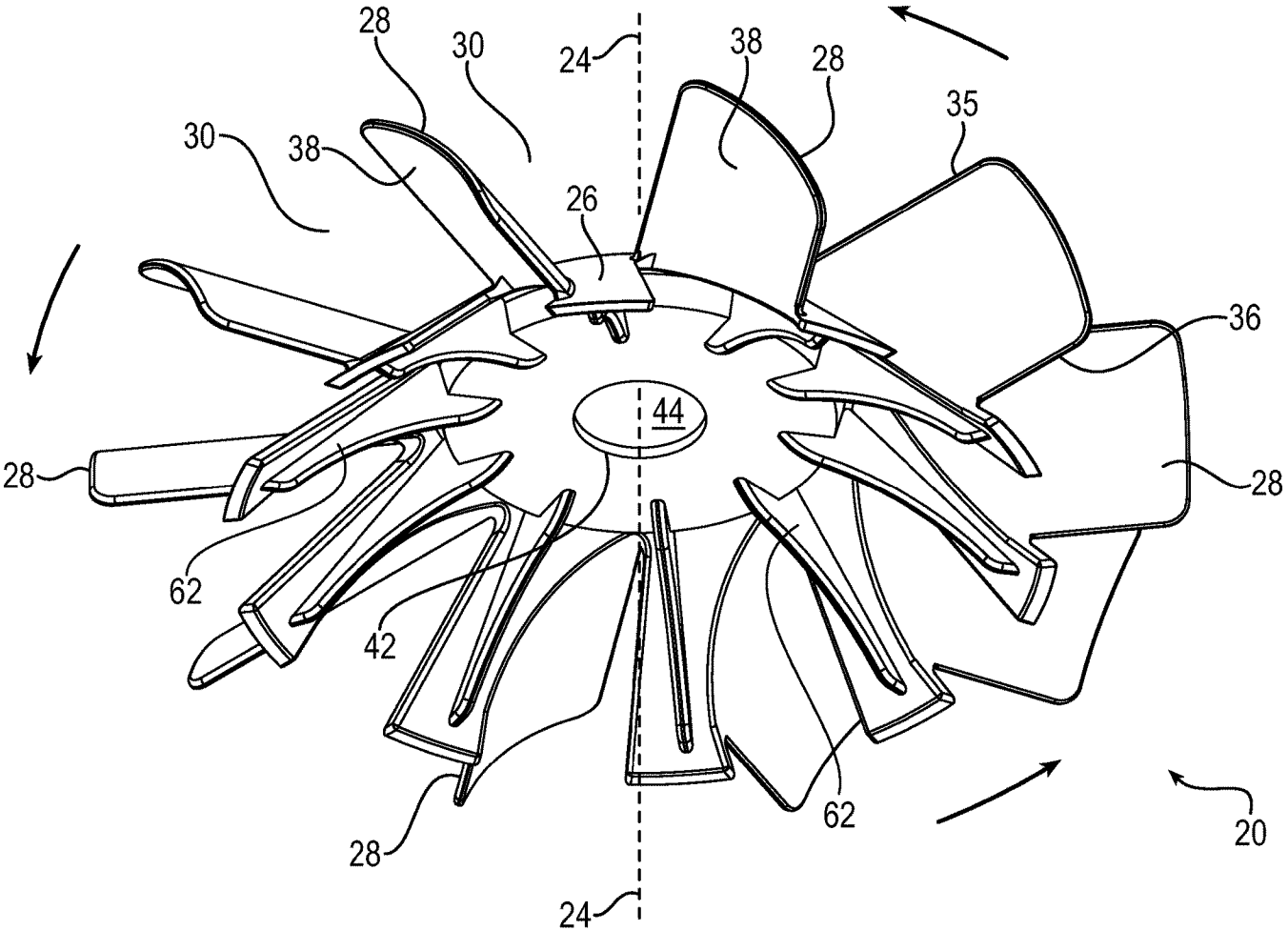
FIG. 5 is an isometric view of the integral fan and airflow guide of FIG. 2.

In the illustrated embodiment, the fan blades 28 extend from the frusto-conical hub 22 at the trailing edges 32 of the slots 30. The fan blades 28 may be sloped relative to the airflow guide surfaces 26 to correspond with the trailing edge 32 of the slot. In this manner, the fan blades 28, which extend perpendicular to a plane that is parallel with the central axis 24, may also extend downwardly toward the trailing direction (as shown in FIG. 3, for example) to be inclined with respect to a plane that is perpendicular to the central axis 24. The fan blades 28 may axially overlie and circumferentially span the respective slots 30, such that a leading upper edge 35 of the fan blade is axially aligned with a leading edge 31 of the slot (as shown in FIG. 4, for example). In some exemplary embodiments, the respective fan blades 28 have a lower edge 36 that does not extend substantially beyond the lower edge 32 of the respective airflow guide surfaces 26. In the illustrated embodiment, the fan blades 28 are curved to have a concave surface 38 opening toward the respective slots 30, which may further improve directing the airflow axially downward through the slots 30.

Still referring to FIGS. 2-5, the hub 22 also includes a radially inner mounting flange 40 configured to operatively couple the integral fan and airflow guide 20 to the input shaft 14. The mounting flange 40 includes a mounting face 42 having an aperture 44 therethrough. The aperture 44 is configured to accept the input shaft 14 (as shown in FIG. 1, for example). The mounting flange 40 may further include one or more locating pins 48, which may help to locate the fastening mechanism 17, for example a washer or spacer, so as to help secure the integral fan and airflow guide 20 to the shaft 14.

The hub 22 also includes an axially extending inward rim 50 that encloses the mounting flange 40. The rim 50 may be cylindrical or conical-shaped, and extends from the mounting flange 40 to the apex 34 of the frusto-conical hub 22. The rim 50 may be configured to axially position the fan blades 28 and airflow guides 26 with respect to the pulley 16 (or other component) depending on a depth of the rim 50.

As shown, the integral fan and airflow guide 20 may further include a plurality of ribs 62 interconnecting respective portions of the inclined segments 26 and respective portions of the mounting flange 40 for enhancing rigidity and restricting flexing of the inclined segments during use. In exemplary embodiments, at least one rib 62 may be connected to the underside of each inclined segment 26 and to an underside of the mounting flange 40 of the hub.

Also as shown, the integral fan and airflow guide 20 may further include a plurality of ribs 64 interconnecting respective portions of the rim 50 and respective portions of an upper face of the mounting flange 40 for enhancing rigidity and restricting flexing during use. In exemplary embodiments, the plurality of ribs 64 connected to the rim 50 may correspond with the plurality of ribs 62 connected to the inclined segments 26.

In preferred embodiments, the entire integral fan and airflow guide 20 is a unitary member. Preferably, the integral fan and airflow guide 20 is configured to be made as a unitary member by an injection molding process. In this manner, the respective slots 30, which separate the airflow guide surfaces 26 and underlie the fan blades 28, may further assist in the injection molding process by providing regions of mold relief. The integral fan and airflow guide 20 may be made from any suitable material, such a plastic, composite, or metal. Preferably, the integral fan and airflow guide 20 is made from an injection moldable thermoplastic, which may help to further reduce the cost to manufacture such a device.

Figure 6:
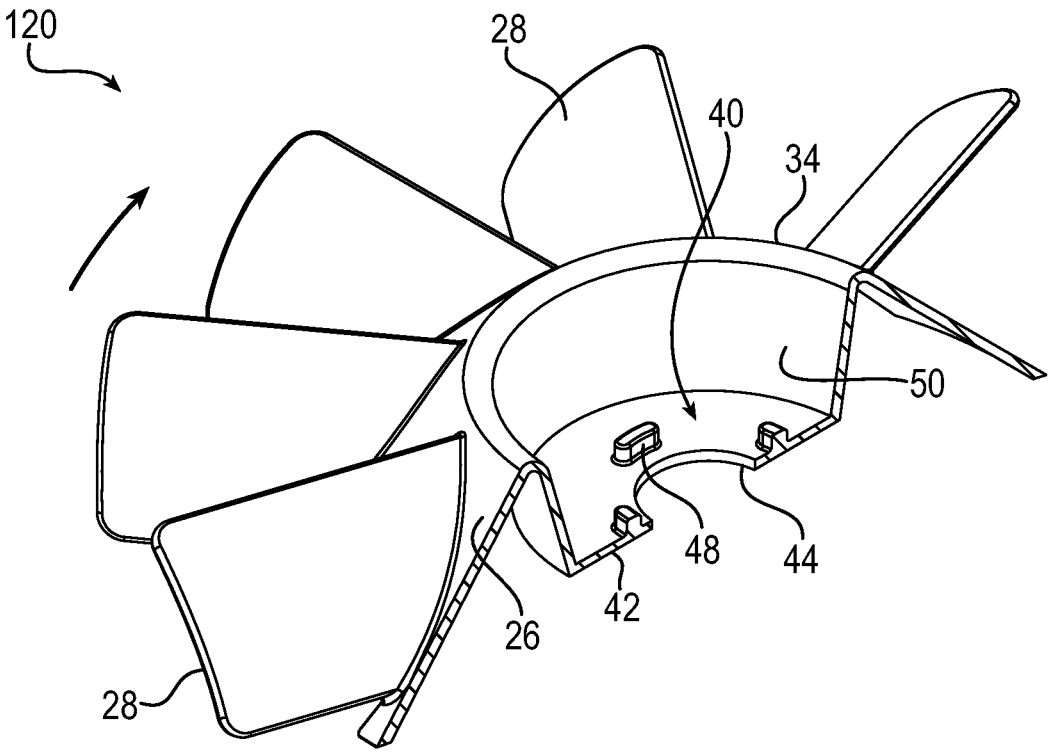
FIG. 6 is an isometric cutaway view of another exemplary integral fan and airflow guide according to the invention.

Turning to FIG. 6, another exemplary embodiment of an integral fan and airflow guide 120 is shown. The integral fan and airflow guide 120 is substantially the same as the above-referenced integral fan and airflow guide 20, except that the axial depth of the rim 48 is deeper in the integral fan and airflow guide 120 compared to the integral fan and airflow guide 20. In addition, the integral fan and airflow guide 120 is devoid of ribs 62 and/or ribs 64, although in exemplary embodiments the ribs 62 and/or ribs 64 may be included. In the illustrated embodiment, the same reference numerals are used to denote structures corresponding to the same or similar structures in the integral fan and airflow guides 20, 120, and the foregoing description of the integral fan and airflow guide 20 is equally applicable to the integral fan and airflow guide 120. As discussed above, such a configuration of the exemplary integral fan and airflow guide 20, 120 described above may improve the cooling effect of machine components, such as hydrostatic transmissions, that may otherwise have airflow from fan blades obstructed by a pulley or other obstacle. For example, referring to FIG. 1, the exemplary hydrostatic transmission 10 has the pulley 16 disposed between the housing 12 and the integral fan and airflow guide 20. As the input shaft 14 rotates (clockwise in the illustrated example), the integral fan and airflow guide 20 impels airflow from above and directs the airflow downward toward the housing 12. More particularly, the inclined airflow guide surfaces 26 may be configured to cooperate with the fan blades 28 to direct the impelled air axially and radially outwardly for an improved air cooling effect.

For example, in the illustrated embodiment of FIG. 1, the inclined airflow guide surfaces 26 are configured to extend to a radially outward edge 60 of the pulley 16 to help direct airflow around the pulley edge 60 to cool the housing 12 below. This is advantageous over known fans for hydrostatic transmissions that typically only direct airflow axially downward, where the axial airflow is then typically blocked by the pulley. In addition, the pulley 16 of the exemplary hydrostatic transmission 10 may have a radial lip 62 at its radial edge 60, and the lower free edges 33 of the respective airflow guide surfaces 26 may be configured to engage an underside of the radial lip 62 so as to restrict upward flexing of the respective guide surfaces 26 in response to forces generated from airflow across the integral unit 20. By reducing such flexing of the exemplary integral fan and airflow guide 20, the longevity of the device may be improved, and the cooling effectiveness may also be improved by maintaining the airflow angle of the respective airflow guide surfaces 26.

In other exemplary embodiments, the mounting face of the pulley 16 may have one or more through-holes 64, and the slots 30 of the integral fan and airflow guide 20 may be configured to allow the impelled airflow to be directed axially through the slots 30, so as to force the axial airflow through the pulley through-holes 64 to cool a radially inward area on the other side of the pulley 16, for example, an area near the shaft 14.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An integral fan and airflow guide for cooling a machine component, comprising:

a hub having a central axis and a frusto-conical outer surface, the frusto-conical outer surface having a plurality of circumferentially spaced apart slots that separate inclined segments of the outer surface to define respective airflow guide surfaces; and a plurality of fan blades circumferentially spaced apart about the hub, the plurality of fan blades radiating outwardly from the hub and being integral with the respective airflow guide surfaces.

2. The integral fan and airflow guide according to claim 1, wherein the airflow guide surfaces are configured to cooperate with the respective fan blades to direct impelled air axially and radially outwardly.

3. The integral fan and airflow guide according to claim 1, wherein the respective fan blades radiate from the hub at respective edges of the slots.

4. The integral fan and airflow guide according to claim 3, wherein the slots have a leading edge and a trailing edge; and wherein the fan blades are integral with the trailing edges of the slots.

5. The integral fan and airflow guide according to claim 1, wherein the slots are wedge-shaped and a wider portion of the wedge-shaped slot is toward a base of the frusto-conical outer surface.

6. The integral fan and airflow guide according to claim 1, wherein the respective fan blades circumferentially span the respective slots.

7. The integral fan and airflow guide according to claim 1, wherein the respective fan blades have a radially inward end, and wherein the radially inward ends of the fan blades are continuously integral with the airflow guide surfaces.

8. The integral fan and airflow guide according to claim 1, wherein the airflow guide surfaces have a lower edge at a base of the frusto-conical outer surface; and wherein the respective fan blades have a lower edge that does not extend beyond the lower edge of the respective airflow guide surfaces.

9. The integral fan and airflow guide according to claim 1, wherein the respective fan blades are sloped relative to the respective airflow guide surfaces.

10. The integral fan and airflow guide according to claim 1, wherein the fan blades are inclined with respect to a plane perpendicular to the central axis, and are perpendicular to a plane parallel with the central axis.

11. The integral fan and airflow guide according to claim 1, wherein the respective fan blades have a concave surface opening toward the respective slots.

12. The integral fan and airflow guide according to claim 1, wherein the hub has a radially inner mounting flange configured to operatively couple the integral fan and airflow guide to a rotating shaft.

13. The integral fan and airflow guide according to claim 12, wherein the mounting flange includes a mounting face.

14. The integral fan and airflow guide according to claim 13, wherein the mounting face has an aperture configured to accept a shaft.

15. The integral fan and airflow guide according to claim 13, wherein the mounting flange includes one or more locating pins.

16. The integral fan and airflow guide according to claim 13, wherein the hub includes an axially extending inward rim that encloses the mounting flange.

17. An integral fan and airflow guide according to claim 1, wherein the integral fan and airflow guide is a unitary molded member.

18. A machine component comprising:

a housing;

a rotatable shaft;

a pulley operatively connected to the shaft; and an integral fan and airflow guide according to claim 1 operatively coupled to the rotatable shaft;

wherein the pulley is disposed between the housing and the integral fan and airflow guide, the pulley having a mounting face and a radial edge enclosing the mounting face, the mounting face of the pulley having at least one through-hole;

wherein the integral fan and airflow guide is configured to direct impelled airflow axially through the respective slots of the hub and through the at least one through-hole of the pulley to cool an area of the housing on the opposite side of the pulley that is radially inward of the radial edge of the pulley; and wherein the integral fan and airflow guide is configured to direct impelled airflow radially toward the radial edge of the pulley to cool an area of the housing on the opposite side of the pulley that is radially outward of the radial edge.

19. An integral fan and airflow guide for cooling a machine component comprising:

a hub having a central axis;

a plurality of airflow guide surfaces extending axially from the hub, the airflow guide surfaces being outwardly inclined with respect to the central axis; and a plurality of radially outwardly extending fan blades circumferentially spaced apart about the hub intermediate the airflow guide surfaces;

wherein the respective airflow guide surfaces are integral with the plurality of fan blades, the airflow guide surfaces being configured to cooperate with the respective fan blades to direct impelled air axially and radially outwardly.

20. A machine component comprising:

a rotatable shaft;

a pulley operatively connected to the shaft; and an integral fan and airflow guide according to claim 1 operatively coupled to the shaft;

wherein the pulley has a radial lip; and wherein a lower free edge of the respective airflow guide surfaces is configured to engage an underside of the radial lip so as to restrict flexing of the respective guide surfaces in response to forces generated from airflow across the integral the integral fan an airflow guide.

* * * * *